United States Patent [19]

Scholz et al.

[11] Patent Number: 4,765,419

[45] Date of Patent: Aug. 23, 1988

[54] ROCK DRILL WITH CUTTING INSERTS

[75] Inventors: Dieter Scholz, Germering; Friedrich Flesch, Kaufering, both of Fed. Rep. of Germany

[73] Assignee: Hilti Aktiengesellschaft, Furstentum, Liechtenstein

[21] Appl. No.: 942,541

[22] Filed: Dec. 16, 1986

[30] Foreign Application Priority Data

Dec. 16, 1985 [DE] Fed. Rep. of Germany ..... 3544433

[51] Int. Cl.[4] ..... E21B 10/36

[52] U.S. Cl. ..... 175/415; 175/410

[58] Field of Search ..... 175/409, 410, 414, 415

[56] References Cited

U.S. PATENT DOCUMENTS

| | | | |
|---|---|---|---|
| 1,056,132 | 3/1913 | Staub | 175/414 |
| 3,163,246 | 12/1964 | Vagins et al. | 175/415 |
| 3,283,837 | 11/1966 | McKain | 175/414 |
| 3,589,456 | 6/1971 | McKain | 175/414 |

FOREIGN PATENT DOCUMENTS

| | | | |
|---|---|---|---|
| 2528003 | 1/1977 | Fed. Rep. of Germany . | |
| 2542001 | 3/1977 | Fed. Rep. of Germany | 175/410 |
| 3004077 | 8/1981 | Fed. Rep. of Germany | 175/415 |
| 1006219 | 4/1952 | France | 175/410 |
| 3623854 | 12/1961 | Japan | 175/410 |
| 311119 | 1/1956 | Switzerland | 175/410 |
| 0636384 | 12/1978 | U.S.S.R. | 175/410 |

*Primary Examiner*—Stephen J. Novosad
*Assistant Examiner*—Terry Lee Melius
*Attorney, Agent, or Firm*—Toren, McGeady & Associates

[57] ABSTRACT

An axially elongated rock drill includes an axially extending shank and a drill head on one end of the shank. The drill head has a drill face extending transversely of the axial direction of the rock drill. A hard metal cutting plate and hard metal cutting pins are set in the drill face. The cutting pins reduce the wear on the cutting plate and afford better support of the drill. The cutting pins are arranged, in part, parallel to the axis of the drill, and, in part, inclined to the drill axis. The cutting plate has a cutting edge which generates a cutting plane as the drill is rotated with the ends of the cutting pins projecting from the drill face being located in the generated cutting plane.

9 Claims, 1 Drawing Sheet

ROCK DRILL WITH CUTTING INSERTS

BACKGROUND OF THE INVENTION

The present invention is directed to a rock drill with an axially extending shank and a drill head on one end of the shank with a drill face on the drill head directed in the drilling direction.

Rock drills are used for cutting boreholes in rock, concrete, masonry and the like and the boreholes serve for receiving fastening elements, for the passage of pipes and cables as well as for blasting. Up to the present time, two different types of rock drills using hard metal inserts have been known.

Rock drills with one or more cutting plates or inserts are relatively easy to produce and basically are used in cutting small diameter boreholes up to a diameter of approximately 35 mm. Such drills, however, have the disadvantage that the cutting edges of the cutting inserts, particularly in the radially outer region, wear out rapidly whereby the progress of the drilling operation rapidly decreases. Furthermore, handling of the rock drills is impaired due to the corner wear.

In particular, in larger diameter drills, as is known from the German OS No. 2 528 003, the drill face of the drill head is provided with hard metal cutting pins. Such cutting pins exert high pressure on the material being cut due to the small contact faces and, as a result, afford better drilling progress. Unlike cutting plates, individual cutting pins are expensive to sharpen. Furthermore, in a drill using cutting pins, the centering of the bore during the initial cutting operation is ineffective. If the individual cutting pins become damaged or broken, the rock drill becomes useless, since in practice the pins cannot be replaced.

SUMMARY OF THE INVENTION

Therefore, it is the primary object of the present invention to provide a rock drill which affords a high drilling efficiency while enabling effective removal of the drilled material and accurate borehole shape and alignment.

The present invention is achieved by a combination of the following features:

(a) the drill face of the drill head has a hard metal cutting plate or insert extending across the entire diameter of the drill head; and (b) the drill face of the drill head is provided with hard metal cutting pins.

The cutting plate enables effective drill operation during the initial drilling procedure. By the addition of the cutting pins, the cutting plate and the cutting pins are applied simultaneously against the material being drilled whereby the cutting edges on the cutting plate experience less wear and the drilling operation is carried out more effectively.

The cutting plate extends axially and radially outwardly from the outside surface of the drill head. Such an arrangement affords a good surface configuration of the borehole as well as accurate borehole alignment and, in addition, it prevents the drill head itself from contact with the borehole surface and avoids premature wear. The extent of the projection of the cutting plate outwardly from the outer surface of the drill head can amount to several millimeters depending on the diameter of the drill head and the thickness of the cutting plate. The cutting plate is sagittally or arrow-head-like shaped, so that it has two cutting edges sloping outwardly from a common center point of the drill head. With the two cutting edges inclined rearwardly, that is, in the opposite direction from the drilling direction, the edges serve for centering the rock drill in the material being cut and the common center point forms a drill tip on the axis of the drill. Preferably, the two cutting edges are inclined relative to one another at an obtuse angle. The angle, at about 130°, prevents excessive wear at the drill tip and affords accurate guidance of the rock drill.

At least a part of the cutting pins can be arranged parallel to the drilling axis for simple fabrication of the rock drill. Since the cutting pins are stressed mainly in the direction of the drilling axis, such an arrangement of the pins results in good wear characteristics for the drill head. By locating the cutting pins parallel to the drilling axis, they can be positioned relatively close to the cutting plate. For better comminution of the material being drilled, at least a part of the cutting pins can be inclined relative to the drilling axis. If the drill face of the drill head has a conical shape, the cutting pins, inclined to the drilling axis, can be oriented approximately perpendicularly to the drill face so that a maximum embedment of the cutting pins can be attained.

When considering the comminution of the material being drilled, it is advantageous if the cutting pins are located at different radii relative to the drilling axis.

Preferably, an axial portion of the cutting pins extends outwardly from the outer surface of the drill head. With the cutting pins projecting beyond the outside surface of the drill head, the compaction and jamming of the drillings between the drill head and the surface of the borehole is prevented. Moreover, the cutting pins assist in forming a high quality borehole surface and assure the accurate alignment of the borehole.

It is advantageous if the free drill ends of the cutting pins are located in the cutting plane generated by the cutting edges of the cutting plate. As a result, when the rock drill is placed against the material to be drilled, the cutting edges of the cutting plate and of the cutting pins are in contact with the material at the same time. This feature maintains the wear of the cutting plate and the cutting pins at a low level and the movement of the drill into the drill material being drilled is not impaired.

The hardness of the cutting pins is adapted in an advantageous manner to the hardness of the cutting plate, so that the cutting pins and the cutting plate are worn down approximately equally and their engagement with the material to be drilled is maintained.

The various features of novelty which characterize the invention are pointed out with particularity in the claims annexed to and forming a part of this disclosure. For a better understanding of the invention, its operating advantages and specific objectives attained by its use, reference should be had to the drawings and descriptive matter in which there are illustrated and described the preferred embodiments of the invention.

DETAILED DESCRIPTION OF THE INVENTION

Figure 1:
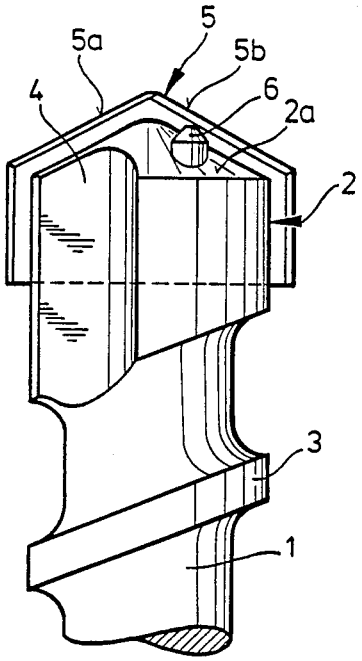
FIG. 1 is an elevational view of a drill head on a rock drill embodying the present invention.
Figure 3:
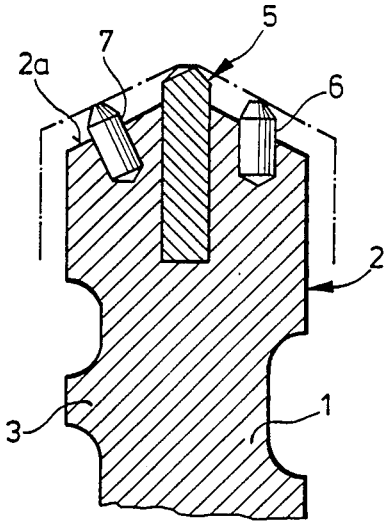
FIG. 3 is a sectional view of the rock drill displayed in FIGS. 1 and 2 and taken along the line III—III in FIG. 2.
Figure 2:
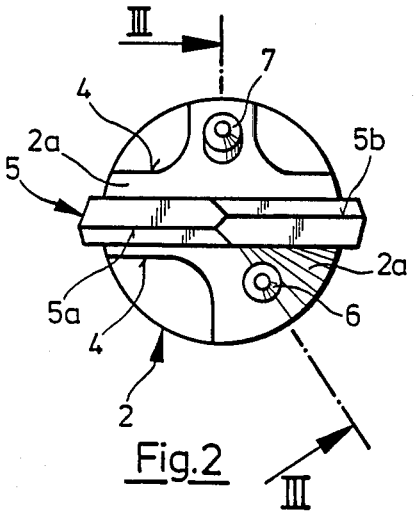
FIG. 2 is a plan view of the drill face of the drill head shown in FIG. 1.

In FIGS. 1–3, the drilling end of an axially elongated rock drill is shown with the drill being formed by an axially extending shank 1 and a drill head 2 secured to one end of the shank. The shank is shaped to provide a conveying helix 3 extending from the drill head toward the opposite end of the drill. The conveying helix serves to guide the drill within a borehole and also to carry away drillings.

As shown in FIGS. 1 and 2, drill head 2 has axially extending removal grooves 4 extending in the axial direction of the drill so that drillings from the drill face 2*a* of the drill head 2 can be conveyed toward the shank 1 for removal from the borehole by the conveying helix 3. The drill head 2 is centered on the rock drill axis and has a relatively flat conically-shaped drill face 2*a* and a cylindrically-shaped axially extending surface extending from the radially outer edge of the drill face to the shank 1. A diammetrically extending, centrally arranged cutting plate 5 is seated within the drill head 2. Cutting plate 5 projects axially from the drill face 2*a* of the drill head 2 and also in the radial direction outwardly from the cylindrical side surface of the drill head. In addition to the cutting plate 5, cutting pins 6 and 7 are seated in the drill face 2*a* of the drill head with the cutting pins spaced outwardly from the drill axis.

As displayed clearly in the sectional view in FIG. 3, the drill or cutting pin 6 is disposed parallel to the drilling axis, while the other drill pin 7 is inclined outwardly away from the drilling axis in the drilling direction. Cutting pins 6, 7 are inserted for a depth in the axial direction of the pins so that the free drilling ends of the pin are located in the conically-shaped rotational plane formed by the cutting edges 5*a*, 5*b* of the cutting plate 5 when the rock drill is rotated. This arrangement assures uniform wear of the cutting plate 2 and the cutting pins 6 and 7 during the drilling operation.

Figure 4:
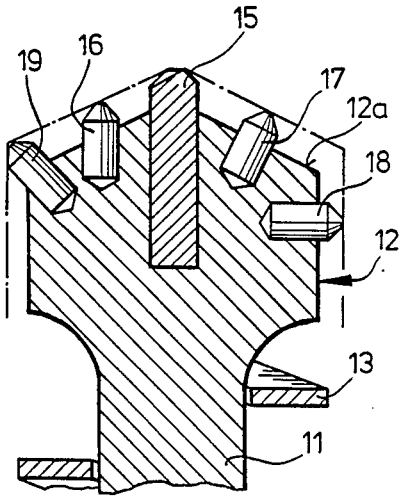
FIG. 4 is a sectional view, similar to that in FIG. 3, displaying another embodiment of a rock drill incorporating the present invention.

In FIG. 4, another embodiment of a rock drill incorporating the present invention is illustrated, where the rock drill has a larger diameter than that shown in FIG. 1 and is formed by an axially extending shank 11 and a drill head 12 extending axially from one end of the shank and projecting radially outwardly from the shank. A separate conveying helix 13 is provided extending around the shank 11. Drill head 12 has a diammetrically extending, centrally arranged cutting plate 15 extending axially outwardly from the front face 12*a* in the axial or drilling direction. The shaped rotational plane of movement of the cutting plate 15 generated during rotation of the rock drill is set forth by dash-dot line. In addition to the cutting plate 15, a plurality of cutting pins 16, 17, 18, 19 are located in and extend outwardly from the drill face 12*a*. Moreover, at least one of the cutting pins extends radially outwardly from the circumferentially extending surface of the drill head extending from the radially outer edge of the drill face 12*a*. Cutting pins 17, 19 are inclined relative to the drilling axis similar to cutting pin 7 in FIG. 3. Cutting pin 16, however, is arranged parallel to the drilling axis. Cutting pin 18 extends perpendicularly to the drilling axis and projects radially outwardly from the circumferentially extending cylindrical surface of the drill head. During the drilling operation, cutting pin 18 is in contact with the borehole surface rearwardly from the drill face and can, as the drilling operation proceeds, serve to roughen the borehole surface. As can be seen in FIG. 4, cutting pins 16, 17, 18, 19 are arranged at different radiis relative to the drilling axis. This arrangement affords a good comminution or breakup of the material being drilled and a uniform distribution of the forces acting on the individual cutting pins. As in the embodiment of FIGS. 1–3, the cutting pins 16, 17, 18, 19 are inserted into the drill head for a depth so that the outwardly located free cutting surfaces of the pins are located in the rotational plane generated by the cutting edges of the cutting plate 15.

While specific embodiments of the invention have been shown and described in detail to illustrate the application of the inventive principles, it will be understood that the invention may be embodied otherwise without departing from such principles.

We claim:

1. An axially elongated rock drill having an axis and drilling direction extending in the axial direction of said rock drill and comprising an axially extending shank having a first end facing in the drilling direction with a drill head secured to and extending in the axial direction of said rock drill from the first end thereof, said drill head has a drill face extending generally transversely of the axial direction and a circumferentially extending side surface extending generally parallel to and encircling the axis of said shank, a hard metal cutting plate inserted into and projecting outwardly from said drill head, said cutting plate extends completely across the diameter of said drill head, generally cylindrically shaped hard metal cutting pins having an axis and being separate from and spaced laterally from said cutting plate and set into said drill face of said drill head, said hard metal cutting plate and cutting pins being formed of a harder material than the drill head, at least certain of said cutting pins being spaced radially inwardly of said circumferentially extending side surface, said cutting plate projects axially in the drilling direction from said drill face and radially outwardly from the circumferentially extending side surface of said drill head, said cutting plate has a center point located on the axis of said rock drill and a pair of cutting edges extending in an arrow-head-like manner radially outwardly from said center point, and said cutting edges extend at an obtuse angle relative to one another.

2. Rock drill, as set forth in claim 1, wherein at least one of said cutting pins is arranged parallel to the drilling axis and is located radially inwardly from the circumferentially extending side surface of said drill head.

3. Rock drill, as wet forth in claim 1, wherein the axis of at least one of said cutting pins is arranged inclined relative to the drilling axis and is located within said drill head radially inwardly of the circumferentially extending side surface of said drill head.

4. Rock drill, as set forth in claim 1, wherein said cutting pins are arranged at different radii relative to the axis said shank.

5. Rock drill, as set forth in claim 1, wherein the cutting edges of said cutting plate generates a rotational plane during the rotation of said rock drill and said cutting pins project axially outwardly from said drill head and have cutting ends extending transversely of the axis thereof and located in the generated rotational plane of said cutting plate.

6. Rock drill having an axis and drilling direction extending in the axial direction of said rock drill and comprising an axially extending shank having a first end facing in the drilling direction with a drill head secured to and extending in the axial direction of said rock drill from the first end thereof, said drill head has a drill face extending generally transversely of the axial direction and a circumferentially extending side surface extending generally parallel to and encircling the axis of said shank, a hard metal cutting plate inserted into and projecting outwardly from said drill head, said cutting plate extends completely across the diameter of said drill head, generally cylindrically shaped hard metal cutting pins having an axis and being separate from and spaced laterally from said cutting plate and set into said drill face of said drill head, said hard metal cutting plate and cutting pins being formed of a harder material than the drill head, at least certain of said cutting pins being spaced radially inwardly of said circumferentially extending side surface, said cutting plate has a central point located on the drilling axis and has arrow-head-like cutting edges extending outwardly in diametrically opposite radial directions relative to the center point with the radially outer edges of cutting cutting edges being located radially outwardly from the circumferentially extending side surface of said drill head, at least two cutting pins located in the drill face and each positioned at a different radius from the center point of the cutting plate and spaced angularly apart around the drilling axis, at least one of said cutting pins having an axis arranged parallel to the drilling axis and at least one other cutting pin having an axis extending at an acute angle relative to the drilling axis and diverging from the drilling axis in the drilling direction.

7. Rock drill, as set forth in claim 6, wherein said drill head having removal grooves formed in the circumferentially extending side surface of said drill head and extending from the drill face to said shank.

8. Rock drill, as set forth in claim 7, wherein said shank has a conveying helix projecting radially outwardly for conveying drillings from said drill head in the direction opposite to the drilling direction.

9. Rock drill having an axis and drilling direction extending in the axial direction of said rock drill and comprising an axially extending shank having a first end facing in the drilling direction with a drill head secured to and extending in the axial direction of said rock drill from the first end thereof, said drill head has a drill face extending generally transversely of the axial direction and a circumferentially extending side surface extending generally parallel to and encircling the axis of said shank, a hard metal cutting plate inserted into and projecting outwardly from said drill head, said cutting plate extends completely across the diameter of said drill head, generally cylindrically shaped hard metal cutting pins having an axis and being separate from and spaced laterally from said cutting plate and set into said drill face of said drill head, said hard metal cutting plate and cutting pins being formed of a harder material than the drill head, at least certain of said cutting pins being spaced radially inwardly of said circumferentially extending side surface, said cutting pins are arranged at different radii relative to the axis of said shank, and at least one of said cutting pins projects radially outwardly beyond the circumferentialy extending side surface of said drill head.

* * * * *